US005237950A

United States Patent [19]

Abe et al.

[11] Patent Number: 5,237,950

[45] Date of Patent: Aug. 24, 1993

[54] ASTRIDE-TYPE SMALL BOAT

[75] Inventors: Tomohisa Abe, Saitama; Jun Ito, Tokyo; Masato Kita, Saitama; Tokio Isono, Tokyo, all of Japan

[73] Assignee: Honda Giken Kogyo Kabushiki Kaisha, Tokyo, Japan

[21] Appl. No.: 811,243

[22] Filed: Dec. 20, 1991

[30] Foreign Application Priority Data

Dec. 21, 1990 [JP] Japan ..... 2-413565

[51] Int. Cl.[5] ..... B63B 35/00

[52] U.S. Cl. ..... 114/270; 114/363

[58] Field of Search ..... 114/270, 363; 440/38, 440/40–43

[56] References Cited

U.S. PATENT DOCUMENTS 4,945,852 8/1990 Kobayashi ..... 114/270

4,998,966 3/1991 Yamaguchi ..... 114/270

OTHER PUBLICATIONS

"Surf Rider", Hot Water magazine, Jan. 1990.

*Primary Examiner*—Jesûs D. Sotelo

*Attorney, Agent, or Firm*—Rosen, Dainow & Jacobs

[57] ABSTRACT

An astride-type small boat sails on water under propulsive forces generated by a propulsion unit driven by an engine mounted in a hull assembly. A driver's seat is disposed on the hull assembly rearwardly of a steering device mounted thereon, with foot spaces defined on opposite sides of said driver's seat. A passenger's seat displaced from the driver's seat in a transverse direction of the hull assembly. The passenger's seat is displaced from the driver's seat in a fore-and-aft direction of the hull assembly.

19 Claims, 10 Drawing Sheets

ASTRIDE-TYPE SMALL BOAT

BACKGROUND OF THE INVENTION

1. Field of the Invention:

The present invention relates to a small boat, and more particularly to a recreational astride-type small boat having seats for a driver and at least one passenger.

2. Description of the Relevant Art:

Conventional recreational astride-type small boats or vessels are known from Japanese Laid-Open Utility Model Publications Nos. 1-122396 and 1-167993, for example. The astride-type small boat disclosed in the former publication has an engine housed in an engine compartment defined in a front half portion of the hull. The engine compartment has a rear partition which separates the engine compartment from the cabin. The rear half portion of the hull is lower in level than the front half portion, and accommodates an astride-type seat extending in the fore-and-aft direction for a driver or navigator and a passenger to sit on.

The astride-type small boat shown in the latter publication also has a seat similar to that of the astride-type small boat disclosed in the former publication.

Both of the above prior astride-type small vessels have a relatively small width or breadth that allows the driver to steer the vessel skillfully with ease so that the driver feels exhilarated when handling the vessel.

The passenger is usually required to be seated astride of the seat while keeping his or her body closely against the back of the driver. If the passenger is a guest or an elderly person, the passenger may feel uncomfortable about the position on the seat. Another problem is that when the passenger's body is pressed against the driver's body, the passenger may not feel relaxed on the boat.

The above problems may be solved by a known bench-type seat that would extend transversely of the vessel and would permit the driver and the passenger to be seated side by side. However, the bench-type seat would result in an increase in the width or breadth of the vessel, and make the vessel less transportable on land. If a vessel with a bench-type seat remained narrow for better handling, the driver and the passenger would still be required to sit closely side by side.

On the small boat disclosed in the former publication, the seat has a front end contiguous to the partition of the engine compartment. The front end of the seat prevents the driver from holding out the legs and also from being seated in a desired position. Since the rear end of the engine compartment is defined by the partition that is positioned in front of the driver's seat region, the leg space for the driver is reduced by the partition. The boat has a fuel tank positioned in front of the engine at the bow of the boat, so that the fuel tank will not interfere with the seat. However, the storage capacity of the fuel tank is limited because the bottom of the vessel has an upward gradient toward the bow.

The small vessel shown in the latter publication includes a trunk compartment positioned near the engine compartment. The trunk compartment has a limited storage capacity because of the equipment in the engine compartment.

The present invention has been made in an effort to solve the aforesaid problems of the conventional recreational astride-type small boats.

SUMMARY OF THE INVENTION

It is an object of the present invention to provide an astride-type small boat which has a minimum width or breadth and still allows a driver and a passenger to stay on board with enough room for them to be seated without holding their bodies closely against each other.

Another object of the present invention is to provide an astride-type small boat which permits a fuel tank with a sufficiently large storage capacity to be mounted thereon.

Still another object of the present invention is to provide an astride-type small boat which has a trunk compartment with a relatively large storage capacity.

According to the present invention, there is provided an astride-type small boat for movement on water under propulsive forces generated by a propulsion unit driven by an engine mounted in a hull assembly, wherein the improvement comprises a driver's seat disposed on the hull assembly rearwardly of a steering device mounted thereon, with foot spaces defined on opposite sides of the driver's seat, and a passenger's seat displaced from the driver's seat in a transverse direction of the hull assembly.

The astride-type small boat further includes a fuel tank disposed in said hull assembly forwardly of the engine.

The hull assembly has a trunk compartment defined in a bow side thereof.

The hull assembly has a space defined in front of a front edge of a seating surface of the driver's seat, for the legs of a driver seated on the driver's seat to be stretched therein.

The above and other objects, features, and advantages of the present invention will become apparent from the following description of illustrative embodiments thereof to be read in conjunction with the accompanying drawings, in which like reference numerals represent the same or similar objects.

DETAILED DESCRIPTION OF THE PREFERRED EMBODIMENTS

Figure 1:
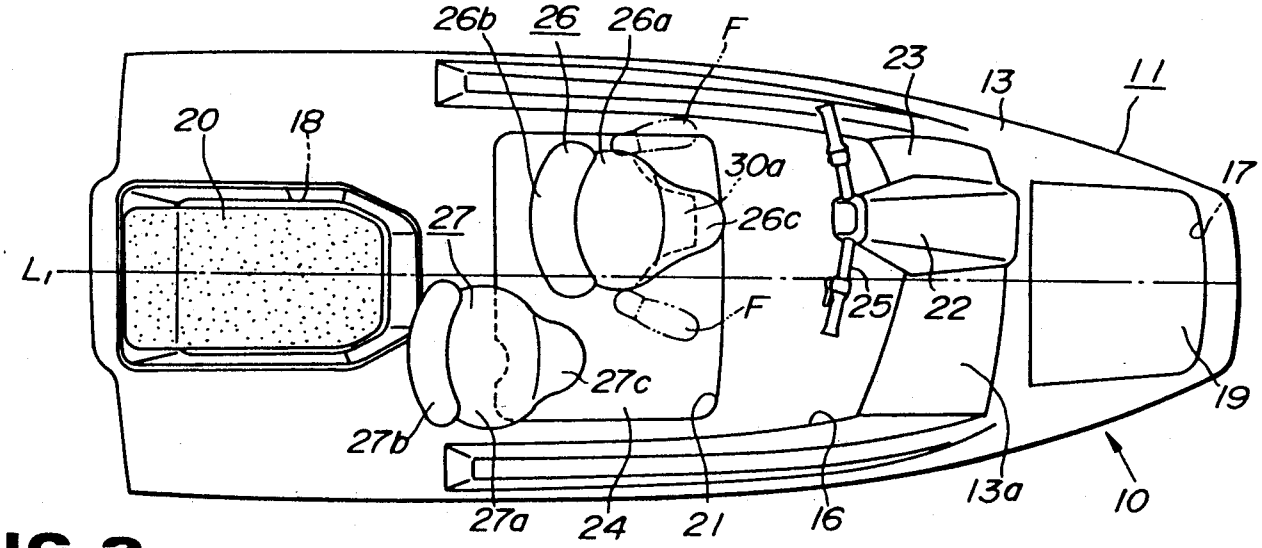
FIG. 1 is a plan view of an astride-type small boat according to a first embodiment of the present invention.

FIGS. 1 through 6 show a recreational astride-type small boat, denoted by the reference numeral 10, according to a first embodiment of the present invention.

Figure 2:
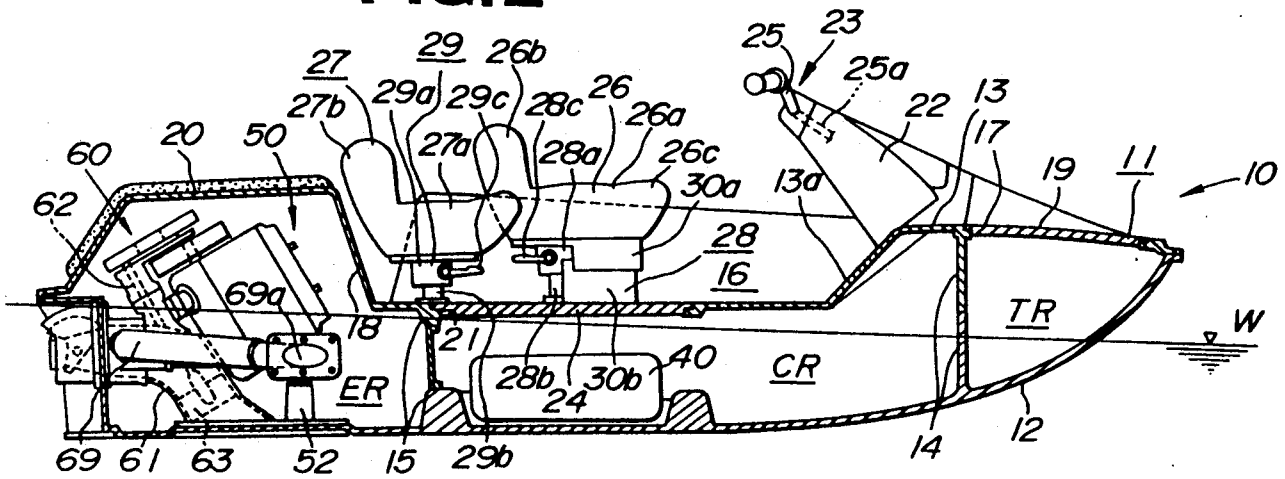
FIG. 2 is a sectional side elevational view of the astride-type small boat shown in FIG. 1.

As shown in FIGS. 1 and 2, the boat 10 comprises a hull assembly 11 including a hull (lower hull) 12 and a floor deck (upper hull) 13 which are joined to each other. The hull 12 and the deck 13 are made of a synthetic resin material such as FRP or the like. The hull assembly 11 defines a trunk compartment TR therein, a central compartment CR, and an engine compartment ER which are successively arranged in the fore-and-aft direction of the boat 10 and divided by partitions 14, 15. The trunk compartment TR is a storage space for accommodating various things. The central compartment CR accommodates a fuel tank 40. The engine compartment ER accommodates an engine 50 and a propulsion unit 60.

The deck 13 has front and rear openings 17, 18 defined therein and a downwardly recessed central cabin 16 which is open upwardly, the cabin 16 being disposed between the front and rear openings 17, 18. The front opening 17 opens into the trunk compartment TR and is openably and closably covered with a lid 19. The rear opening 18 opens into the engine compartment ER and is openably and closably covered with a hood 20.

The cabin 16 has a bottom wall with an opening 21 defined therein and a front wall 13*a* on which a steering device 23 is mounted on the lefthand side of the hull assembly 11. The opening 21 opens into the central compartment CR and is openably and closably covered with a cover 24. The steering device 23 comprises a steering post 22 having an upper end to which a steering handle (control bar) 25 is connected. The steering handle 25 is operatively coupled to a propulsion unit 60 through a cable (not shown). The steering post 22 has a lower end fixed to the front wall 13*a*, the steering post 22 being inclined rearwardly (to the left in FIG. 2) in the upward direction with its upper end directed obliquely upwardly. The steering handle 25 is tiltably attached to the upper end (rear end) of the steering post 22. The steering handle 25 is connected to a steering shaft 25*a* in the steering post 22.

A driver's astride-type seat 26 and a passenger's astride-type seat 27 are independently mounted in the cabin 16. The driver's seat 26 and the passenger's seat 27 are staggered or spaced from each other in the fore-and-aft direction and also in the transverse direction of the boat 10. The driver's seat 26 is positioned behind the steering device 23, and the passenger's seat 27 is positioned on the righthand side of the hull assembly 11. Specifically, the driver's seat 26 and the passenger's seat 27 are positioned on the lefthand and righthand sides, respectively, of a longitudinal central line L1 of the small boat 10.

The driver's seat 26 comprises a seat bottom 26*a* and a seat back 26*b* extending upwardly from the rear end of the seat bottom 26*a*. The seat bottom 26*a* is supported on the cover 24 by a leg 28 that houses a height adjusting mechanism. As shown in FIG. 1, the driver's seat 26 includes a knee grip 26*c* of smaller width integral with the front end of the seat bottom 26*a*. Foot spaces F (indicated by the imaginary lines) are provided on the deck 13 on the lefthand and righthand sides of the knee grip 26*c*.

As shown in FIG. 2, the leg 28 of the driver's seat 26 has a frame 28*a* fixed to the lower surface of the seat bottom 26*a* and a frame 28*b* fixedly mounted on the cover 24. The frames 28*a*, 28*b* are coupled to each other for vertical displacement relative to each other. As with the known seat height adjusting mechanism, the frames 28*a*, 28*b* of the leg 28 can be fixed in relative vertical positions by a lever 28*c* for thereby adjusting the height of the upper seating surface of the seat bottom 26*a*.

A cover 30*a* is suspended from the lower surface of the seat bottom 26*a* of the driver's seat 26 in covering relation to a front portion of the frame 28*a*. Another cover 30*b* is vertically mounted on the cover 24 in covering relation to a front portion of the frame 28*b*. As illustrated in FIG. 1, the cover 30*a* is of a shape smaller than, but similar to, the shape of the seat bottom 26*a*, as viewed in plan, and has an outer edge positioned behind the outer edge of the seat bottom 26*a*, i.e., positioned within the area of the seat bottom 26*a*, as viewed in plan. The cover 30*b* has foot steps (not shown) for supporting the feet of the driver.

The passenger's seat 27 also comprises a seat bottom 27*a* and a seat back 27*b* extending upwardly from the rear end of the seat bottom 27*a*. The seat bottom 27*a* is supported on the deck 13 by a leg 29 that houses a height adjusting mechanism. As with the driver's seat 26, the passenger's seat 27 includes a knee grip 27*c* integral with the front end of the seat bottom 27*a*. Foot spaces are also provided on the deck 13 on the lefthand and righthand sides of the knee grip 27*c*.

The leg 29 of the passenger's seat 27 has a frame 29*a* fixed to the lower surface of the seat bottom 27*a* and a frame 28*b* fixedly mounted on the cover 24. The frames 29*a*, 29*b* are coupled to each other for vertical displacement relative to each other. The frames 29*a*, 29*b* of the leg 29 can be fixed in relative vertical positions by a lever 29*c* for adjusting the height of the upper seating surface of the seat bottom 27*a*.

The frames 28*b*, 29*b* of the legs 28, 29 may be detachably mounted on the cover 24.

Figure 3:
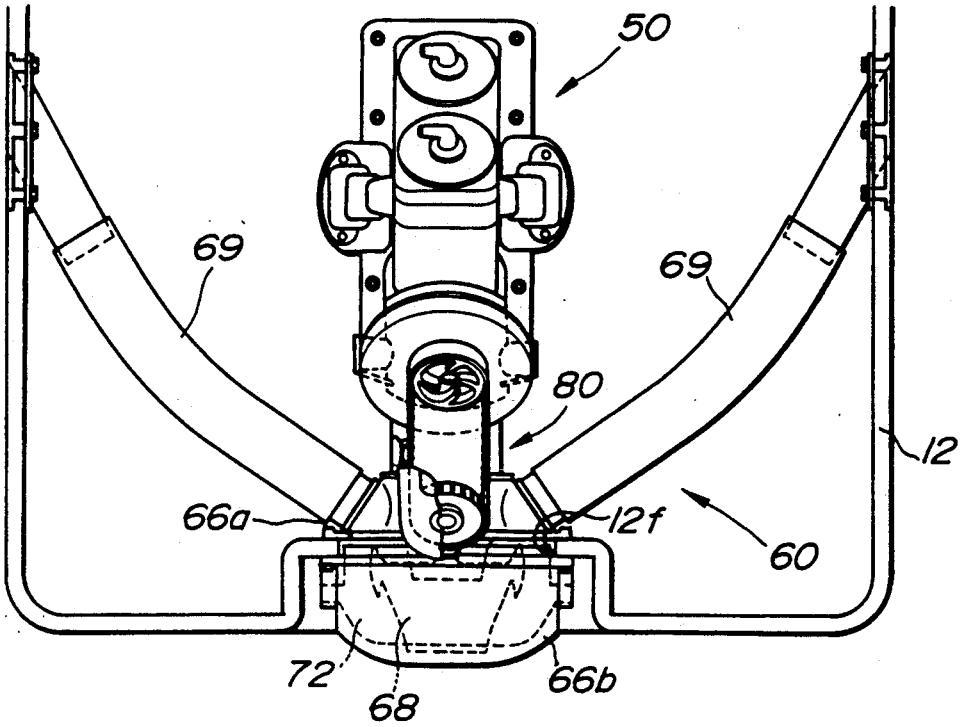
FIG. 3 is a plan view of a propulsion unit of the astride-type small boat shown in FIG. 1.
Figure 4:
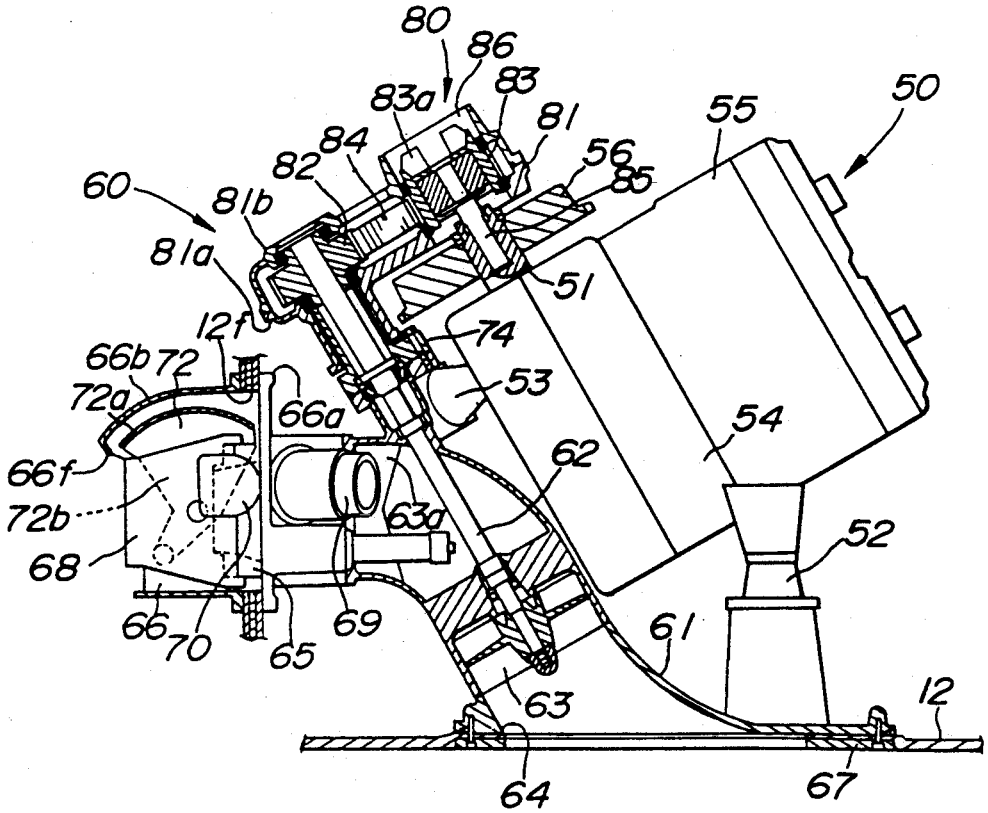
FIG. 4 is a side elevational view, partly in cross section, of the propulsion unit shown in FIG. 3.

As shown in FIGS. 3 and 4, the propulsion unit 60 has a pump housing 61 in which there is rotatably housed an impeller 63 fixed to the lower end of an impeller shaft 62. The pump housing 61 comprises a tubular member that is gradually curved rearwardly in the upward direction (FIG. 4). The pump housing 61 has an intake port 64 defined in its front end which opens in the bottom of the hull 12, and is connected at its rear end to a nozzle 65. The intake port 64 of the pump housing 61 has a peripheral edge fixed to the bottom of the hull 12 by bolts that extend through a set plate 67 attached to the outer surface of the bottom of the hull 12. The nozzle 65 is threadedly attached to a reverse cover 65*b*. A flow-rectifying plate 63*a* is disposed in the pump housing 61 downstream of the impeller 63 with respect to the direction of a water flow in the pump housing 61.

The nozzle 65 is integral with a reverse body 66*a*, and opens right in the rearward direction of the hull assembly 11. The nozzle 65 extends rearwardly through a hole 12*f* (see FIG. 3) defined in the hull assembly 12. A steering nozzle 68 is attached to the rear end of the nozzle 65 for lateral angular movement about a vertical axis. The steering nozzle 68 is of a tubular shape whose diameter is progressively reduced in the rearward direction. As described later on, the steering nozzle 68 is positioned within a reverse chamber 66, and is covered with the reverse cover 66*b* on upper, lower, lefthand, and righthand sides except a rear side thereof. The steering nozzle 68 has a front end loosely fitted over the nozzle 65, and is supported at its upper and lower front end portions on the nozzle 65 for angular movement about the vertical axis.

Figure 5:
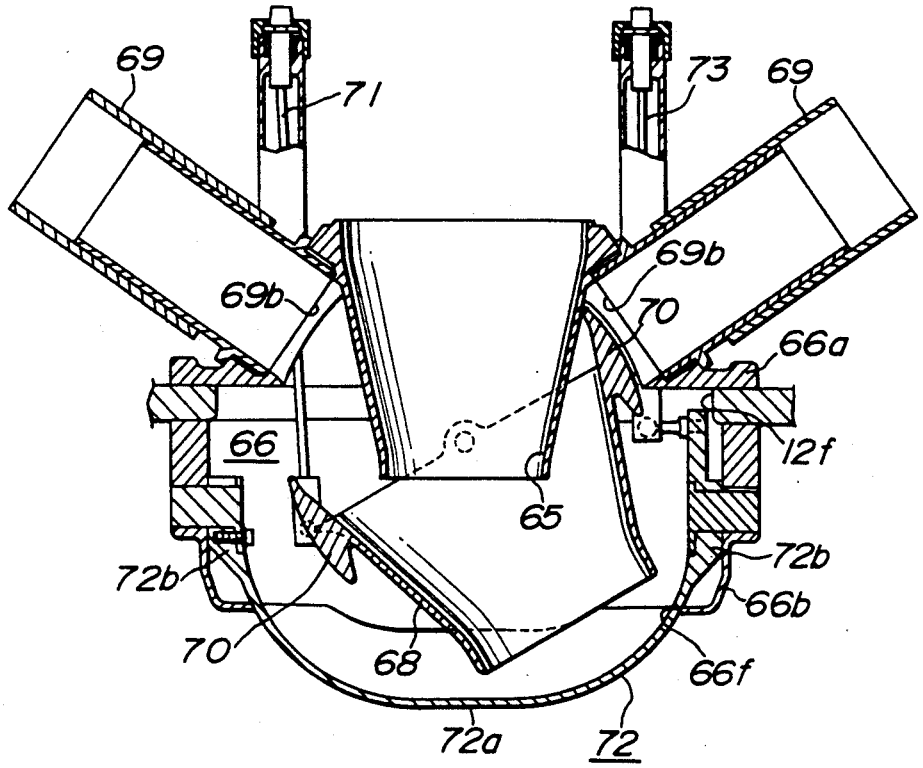
FIG. 5 is a sectional plan view of a portion of the propulsion unit shown in FIG. 3.
Figure 6:
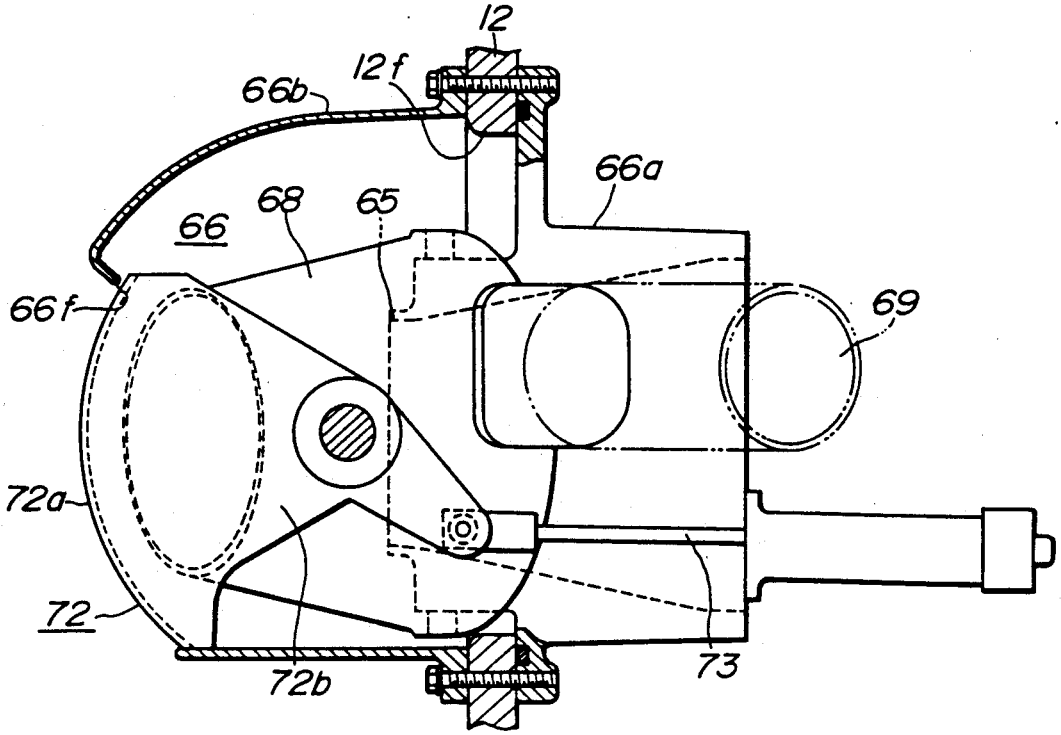
FIG. 6 is a sectional side elevational view of a portion of the propulsion unit shown in FIG. 3.

As shown in FIGS. 5 and 6, the reverse body 66*a* and the reverse cover 66*b* are fastened to respective inner and outer surfaces of the stern of the hull assembly 12 by means of bolts. The reverse body 66*a* and the reverse cover 66*b* surround the hole 12*f* defined in the stern of the hull assembly 12, and defines the reverse chamber 66 therein. To the reverse body 66*a*, there are connected reverse pipes 69 that open into the reverse chamber 66 on the lefthand and righthand sides of the nozzle 65. The reverse cover 66*b* has an opening 66*f* defined in its rear end which can be selectively opened and closed by a reverse bucket 72 (described later on). The nozzle 65 opens into the reverse chamber 66, in which the steering nozzle 68 is accommodated.

The steering nozzle 68 has chopper valves 70 integrally formed respectively on lefthand and righthand sides thereof for selectively opening and closing the reverse pipes 69 into and out of communication with the reverse chamber 66. A cable 71 connected to the steering handle 25 is joined to the lefthand side of the steering nozzle 68. In response to a steering action of the steering handle 25, the steering nozzle 68 changes the direction in which water is ejected from the nozzle 65 and also selectively opens and closes the reverse pipes 69.

As shown in FIGS. 2 and 3, the reverse pipes 69 extend obliquely laterally in the fore-and-aft direction, and have front ends bolted to inner surfaces of side walls of the hull assembly 12 and opening, at 69*a*, out of the side walls of the hull assembly obliquely in the forward direction. The reverse pipes 69 have rear ends opening into the reverse chamber 66 obliquely in the rearward direction. The reverse pipes 29 are selectively brought into communication with the reverse chamber 66 by the chopper valves 70.

The reverse bucket 72 for selectively opening and closing the opening 66*f* of the reverse cover 66*b* is disposed in the reverse chamber 66 within the reverse cover 66*b*. The reverse bucket 72 is of a substantially inverted U shape as viewed in rear elevation and of a substantially sectorial shape as viewed in side elevation. The reverse bucket 72 comprises a pair of side plates 72*b* and a valve plate 72*a* integrally joined therebetween for selectively opening and closing the opening 66*f*. The side plates 72*b* are coupled to respective lefthand and righthand inner surfaces of the reverse cover 66*b* for angular movement about a horizontal axis. The reverse bucket 72 has a righthand side plate to which there is joined a cable 73 that is coupled to a forward/reverse selector lever of the steering device 23. In response to an action of the forward/reverse selector lever, the reverse bucket 72 closes the opening 66*f* of the reverse cover 66*b* when a reverse range is selected (see FIG. 6).

As shown in FIG. 4, the impeller shaft 62 extends obliquely rearwardly in the upward direction in the pump housing 61. The impeller shaft 62 also extends through a hollow pivot shaft 74 fixed to an upper portion of the pump housing 61 and has an upper end projecting into a case 81. As described above, the impeller 63 is fixed to the lower end of the impeller shaft 62. The impeller shaft 62 is rotatably supported at its upper, intermediate, and lower portions by bearings. The upper end of the impeller shaft 62 is operatively coupled to a crankshaft 51 of an engine 50 through a belt transmission device 80.

As shown in FIG. 4, the belt transmission device 80 is housed in the case 81, which comprises a main case member 81*a* and a cover 81*b* joined thereto. The belt transmission device 80 comprises a driven pulley 82, a drive pulley 83, and a belt 84 trained around the driven and drive pulleys 82, 83. The main case member 81*a* of the case 80 has a rear lower portion supported by a pivot shaft 74 (described later on). The cover 81*b* has a hole 86 therein for introducing cooling air, the hole 86 being positioned upwardly of the drive pulley 83. The driven pulley 82 is fixedly mounted on the upper end of the impeller shaft 62. The drive pulley 83 is fixedly mounted on a rotatable shaft 85 coaxially coupled to the crankshaft 51 of the engine 50. The drive pulley 83 has a cooling fan 83*a* on its upper surface. The belt transmission device 80 serves to transmit the power of the engine 50 to the impeller shaft 62.

The engine 50 comprises a two-cylinder, two-stroke engine and has a bottom supported on the bottom of the hull assembly 12 by a pair of laterally spaced mounts 52 and a rear portion supported on the pump housing 61 by a mount 53. The engine 50 also has a crankcase 54 positioned on its rear side and a cylinder head 55 on its front side. The crankshaft 51 extends obliquely rearwardly in the upward direction parallel to the impeller shaft 62. As described above, the rotatable shaft 85 is coaxially coupled to the crankshaft 51 for rotation therewith. A flywheel 56 is fixed to the crankshaft 51 beneath the case 81. The engine 50 has a throttle valve (not shown) operatively coupled to an accelerator grip or accelerator lever (not shown) of the steering device 23.

The propulsion unit 60 operates as follows: When a driver is on board the boat 10, either singly or with a passenger, the boat sinks up to a water line W (FIG. 2), with the front end openings 69*a* of the reverse pipes 69 and the intake port 64 being positioned below the water line W. FIG. 4 shows the condition when the boat 10 moves forwardly. Water introduced from the intake port 64 is ejected rearwardly from the steering nozzle 68 by the impeller 63, propelling the boat 10 in the forward direction under reactive forces. At this time, the steering nozzle 68 can be controlled by the steering handle 25. To reverse the boat 10, the forward/reverse selector lever of the steering device 23 is operated on to cause the valve plate 72*a* of the reverse bucket 72 to cover the rear opening 66*f* of the reverse cover 66*b*, as shown in FIGS. 5 and 6. Therefore, the water ejected rearwardly from the steering nozzle 68 flows from the reverse chamber 66 into the reverse pipes 69, and is ejected obliquely forwardly with respect to the hull assembly 11 from the front end openings 69*a* of the reverse pipes 69. The boat 11 thus moves rearwardly under reactive forces. When the steering handle 25 is turned to angularly move the steering nozzle 68, the chopper valves 70 of the steering nozzle 68 close the rear end openings 69*b* of the reverse pipes 69 to a selected degree, thus determining the direction in which the boat 10 is reversed.

Unless particularly described otherwise, the propulsion units of astride-type small boats according to other embodiments (described later on) is identical in structure to the propulsion unit 60 described above.

In the above astride-type small boat 10, the driver's seat 26 and the passenger's seat 27 are disposed in the cabin 16 and arranged in the transverse direction of the hull assembly 12, and the foot spaces F are provided on the floor of the cabin 16 on the opposite sides of the seat bottom 26*a* of the driver's seat 26. This arrangement allows the driver and the passenger to stay on board the boat 10 in a relaxed manner without being held against each other, while minimizing the width of the boat 10. More specifically, when the driver is to be seated on the driver's seat 26, the driver can place the legs in the foot spaces F and sit on the driver's seat 26 comfortably. As the space in front of the passenger's seat 27 is open and not shielded by the driver's seat 26, the passenger seated on the passenger's seat 27 feels relaxed in the forward direction. Since the width of the boat 10 is minimized, the boat 10 remains highly transportable on land.

The driver's seat 26 and the passenger's seat 27 are staggered or displaced from each other in both the transverse and fore-and-aft directions of the boat 10. Thus, the width of the boat 10 is not increased, and relatively large spaces are available around the seats 26, 27, particularly around the shoulders of the driver and the passenger who are seated on the seats 26, 27, respectively.

The engine compartment ER which houses the engine 50 is positioned in the rear portion of hull assembly 11. Consequently, the layout of the front wall 13*a* of the cabin 16 has a large degree of freedom. That is, the front wall 13*a* of the cabin 16 may be positioned forwardly to provide a large space in the cabin 16 in front of the seats 26, 27. The large space thus created permits the driver to stretch the legs in front of the driver's seat 26, and gives a sufficiently large area for the driver's legs. Accordingly, the driver and the passenger can stay on board the boat 10 comfortably in a relaxed manner while enjoying the sailing on water.

Furthermore, the trunk compartment TR in the front portion of the hull assembly 11 is independent of the engine 50 and is of a large storage capacity, fully utilizing the available space in the hull assembly 11. The trunk compartment TR is positioned near the driver's seat 26, and hence can easily be accessed for use. The fuel tank 40 is positioned in the central compartment CR, i.e., is positioned at the center of the hull assembly 11 in the fore-and-aft direction, or at the center of gravity of the hull assembly 11. Consequently, any adverse effect which the varying amount of fuel in the fuel tank 40 may have on the weight balance of the boat 10 is minimized. Since the fuel tank 40 is positioned out of physical interference with the engine 50, the fuel tank 40 may be of increased storage capacity.

The heights of the seat bottoms 26*a*, 27*a* of the seats 26, 27 can be varied by the height adjusting mechanisms housed in the respective legs 28, 29 that support the seats 26, 27 on the deck 13. Therefore, the heights of the seat bottoms 26*a*, 27*a* can be adjusted to allow the driver and the passenger to have suitable viewpoints and/or seating attitudes depending on the physiques of the driver and the passengers.

As viewed in plan, the outer edge of the leg 28 of the driver's seat 26, i.e., the outer edges of the covers 30*a*, 30*b*, are smaller than the outer edge of the seat bottom 26*a*, giving relatively large room for the legs of the driver.

The steering post 22 which extends obliquely rearwardly in the upward direction is mounted on an upper half portion of the front wall 13*a* of the cabin 16, and the steering handle 25 is mounted on the rear end of the steering post 22. Therefore, there is available a space directly below the steering device 23, permitting the driver to throw the legs therein as desired.

Figure 7:
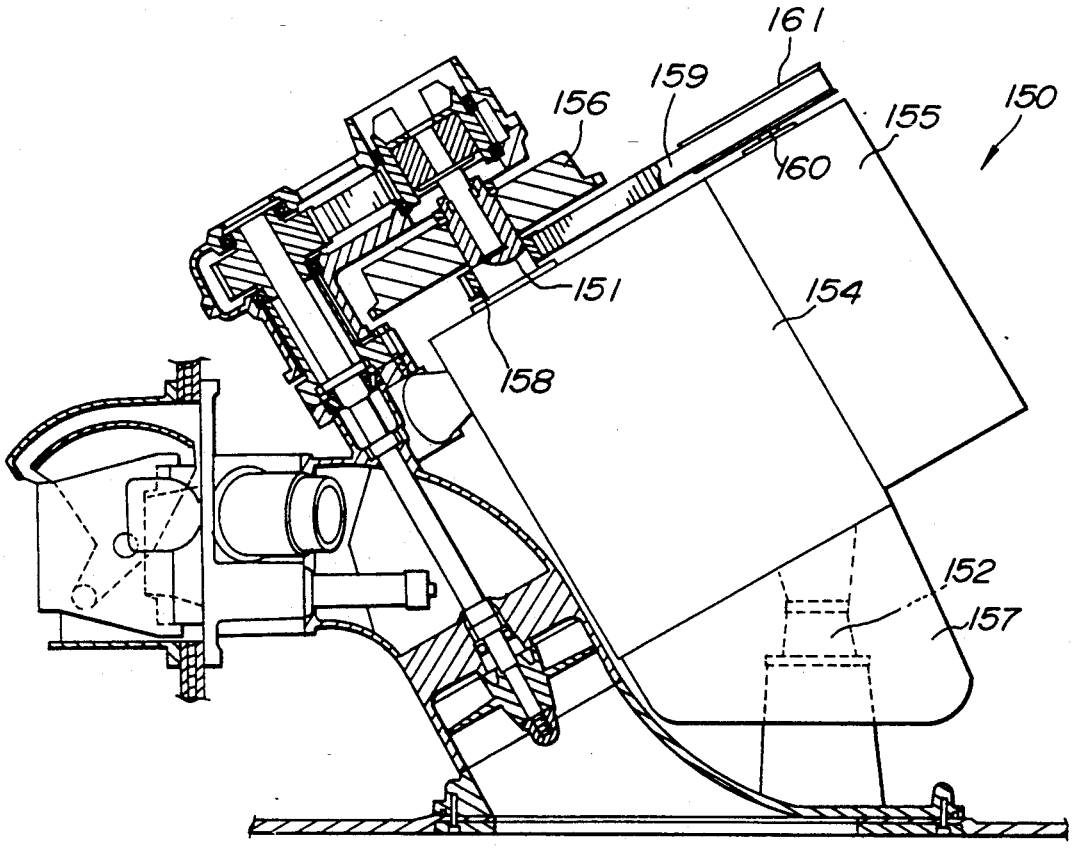
FIG. 7 is a side elevational view, partly in cross section, of an alternative engine for the astride-type small boat shown in FIG. 1.

The engine on the boat is not limited to the illustrated two-cylinder, two-stroke engine, but may comprise a four-cycle engine 150 as shown in FIG. 7. As shown in FIG. 7, the engine 150 has a crankcase 154, an oil pan 157 attached to the lower surface of the crankcase 154 between mounts 152, and a crankshaft 151 to which a crank pulley 158 is fixed below a flywheel 156 mounted on the crankshaft 151. The crank pulley 158 is operatively coupled to a valve operating mechanism (not shown) in power transmitting relationship by a timing belt 159 trained around the crank pulley 158. The valve operating mechanism comprises a camshaft and rocker arms (not shown) covered with a cover and housed in a cylinder head 155. The camshaft has an upper end 160 on which a cam pulley 161 is fixedly mounted. The timing belt 159 is also trained around the cam pulley 161.

Figure 8:
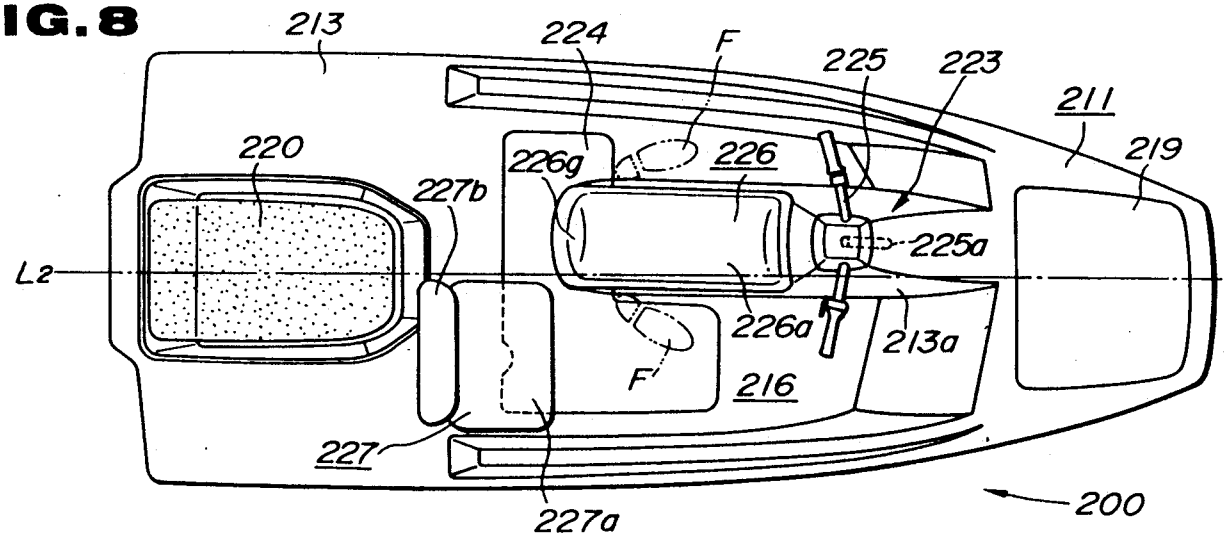
FIGS. 8 and 9 are plan and side elevational views, respectively, of an astride-type small boat according to a second embodiment of the present invention.
Figure 9:
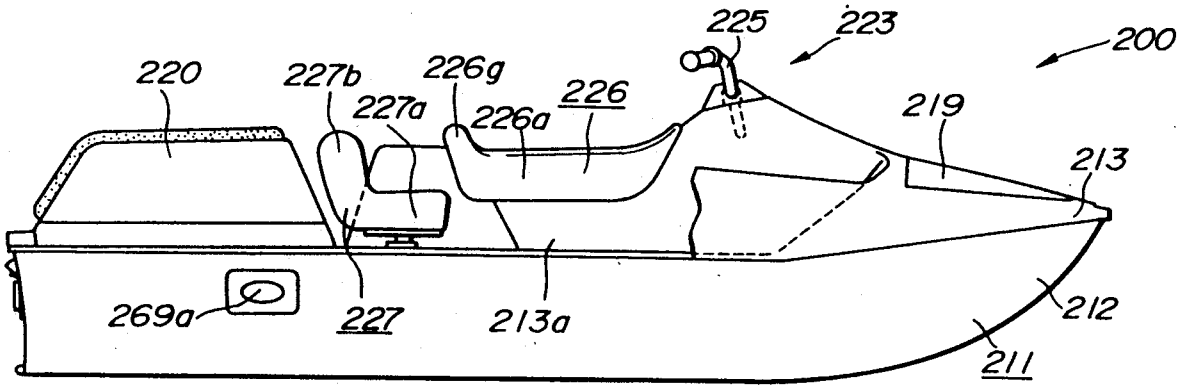

FIGS. 8 and 9 show a recreational astride-type small boat 200 according to a second embodiment of the present invention. Those parts shown in FIGS. 8 and 9 which are identical to those of the small boat 10 according to the first embodiment are denoted by identical reference numerals plus "200", and will not be described in detail.

The small boat 200 includes a driver's seat 226 having a seat bottom 226*a* that is elongate in the fore-and-aft direction and includes a vertical protrusion 226*g* extending upwardly from the rear end of the seat bottom 226*a*. The driver's seat 226 is positioned on the lefthand side of a longitudinal central line L2 of a hull assembly 211, and is mounted on a raised portion 213*a* integrally formed on the deck 213.

The raised portion 213*a* extends continuously rearwardly from a bow side in a cabin 216 of a deck 213 at a position that is spaced a certain distance to the left from the longitudinal central line L2. On the raised portion 213*a*, there are supported in successive positions the driver's seat 226 and a steering device 223 including a steering handle 225 in front of the driver's seat 226. The steering device 223 is tiltable in the rearward direction.

The driver's seat 226 on the raised portion 213*a* is therefore displaced a certain distance to the left from the longitudinal central line L2. The floor of the cabin 216 has foot spaces F available on the opposite sides of the driver's seat 226.

The small boat 200 also includes a passenger's seat 227 displaced to the right from the longitudinal central line L2 by a distance greater than the distance by which the driver's seat 226 is spaced from the longitudinal central line L2. The passenger's seat 227 is positioned rearwardly of the driver's seat 226.

As with the small boat 10 according to the first embodiment, the small boat 200 according to the second embodiment allows the driver and the passenger to stay on board the boat 11 in a relaxed manner without being held against each other, while minimizing the width of the boat 200.

Moreover, the foot spaces F provided on the opposite sides of the driver's seat 226 permit the driver to sit on the driver's seat 26 comfortably. The driver's seat 226 and the passenger's seat 227 are staggered to allow the passenger seated on the passenger's seat 227 to feel relaxed in the forward direction.

Figure 10:
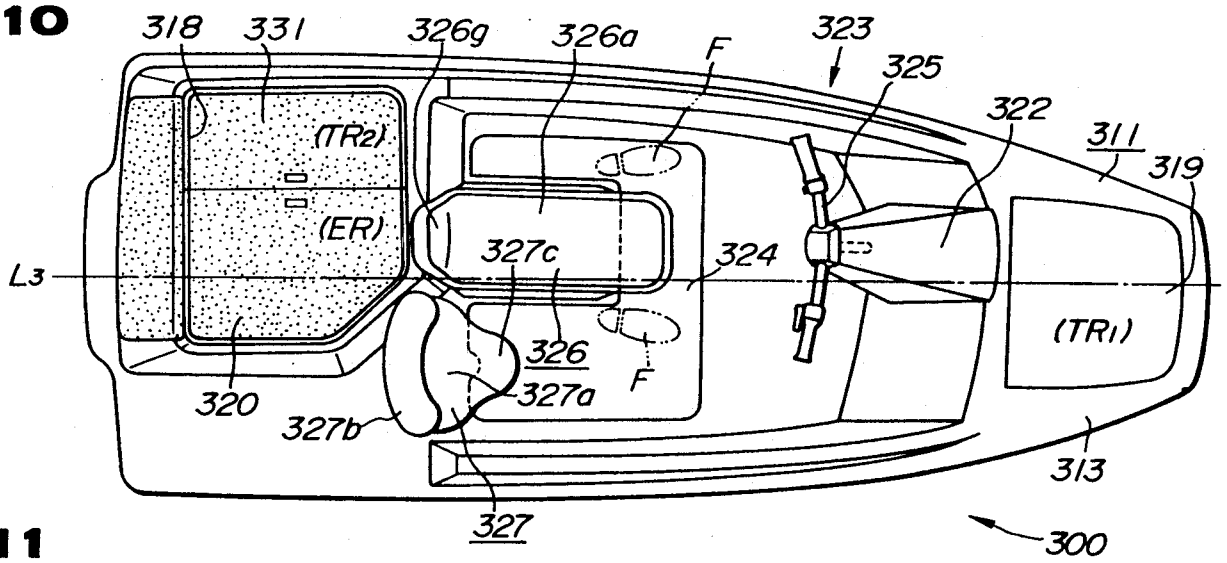
FIGS. 10 and 11 are plan and side elevational views, respectively, of an astride-type small boat according to a third embodiment of the present invention.
Figure 11:
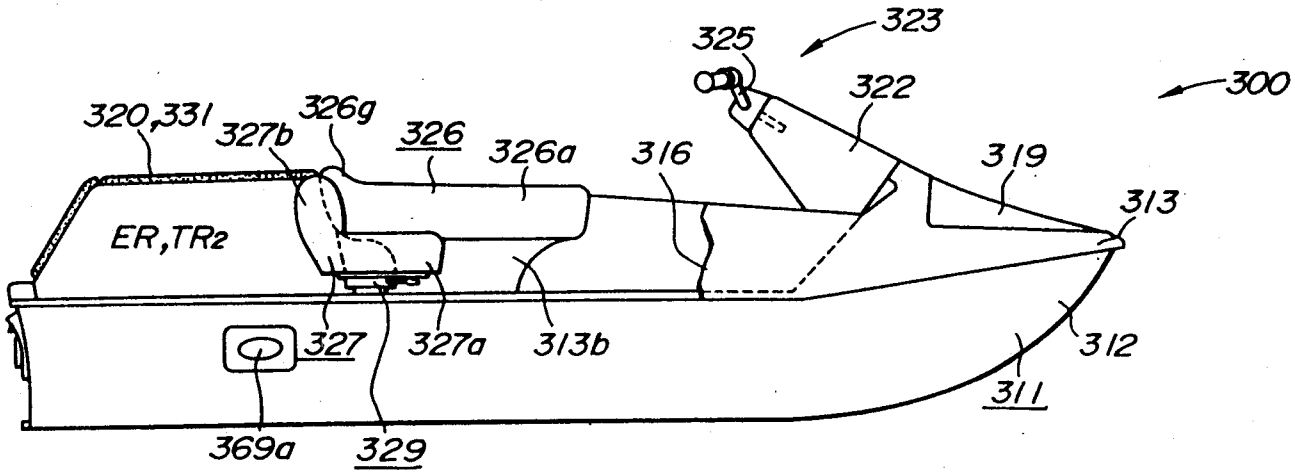

FIGS. 10 and 11 show a recreational astride-type small boat 300 according to a third embodiment of the present invention. Those parts shown in FIGS. 10 and 11 which are identical to those of the small boat 10 according to the first embodiment are denoted by identical reference numerals plus "300", and will not be described in detail.

The small boat 300 has a deck 313 including an integral raised portion **313*b* extending continuously forwardly from a rear wall of a cabin 316. The boat 300 includes a driver's seat 326 mounted on the raised portion 313*b* and a passenger's seat 327 disposed in the cabin 316. The driver's seat 326 and a passenger's seat 327 are staggered with respect to each other, the driver's seat 326 being displaced to the left from a longitudinal central axis L3 of a hull assembly 311 and the passenger's seat 327** to the right from the longitudinal central line L3.

The seats 326, 327 have respective seat bottoms **326*a*, 327*a* at different heights. Actually, the seat bottom 326*a* is higher than the seat bottom 327*a*. The passenger's seat 327 is supported on the deck 313 by a leg 329 housing a height adjusting mechanism. The passenger's seat 327 has a knee grip 327*c* on the front end of the seat bottom 327*a*. The seats 326, 327** are disposed on the lefthand and right-hand sides, respectively, of the longitudinal central line L3.

The small boat 300 additionally has a second trunk compartment TR2 in a rear lefthand portion of the hull assembly 311 adjacent to the engine compartment ER. The engine compartment ER and the second trunk compartment TR2 can be accessed through a common opening 318 that is covered with a lid or cover 331 and a hood 320 that can independently be opened and closed which are positioned over the engine compartment ER and the second trunk compartment TR2, respectively. The engine compartment ER and the second trunk compartment TR2 may be accessed through respective openings.

Since the driver's seat 326 is mounted on the raised portion **313*b* contiguous to the rear wall of the cabin 316, a large space is created in front of the driver's seat 326. Because the height of the seat bottom 327*a* of the passenger's seat 327 is lower than the height of the seat bottom 326*a* of the driver's seat 326, the shoulders of the driver seated on the driver's seat 326 and the passenger seated on the passenger's seat 327 are prevented from touching each other, without the spacing between the seats 326, 327 being increased, i.e., without the width of the boat 300** being increased.

The small boat 300 has a trunk compartment TR1 in a front portion of the hull assembly 311, in addition to the second trunk compartment TR2 in the rear portion of the hull assembly 311. These two trunk compartments TR1, TR2 can accommodate a large number of things, and can be accessed with ease.

Figure 12:
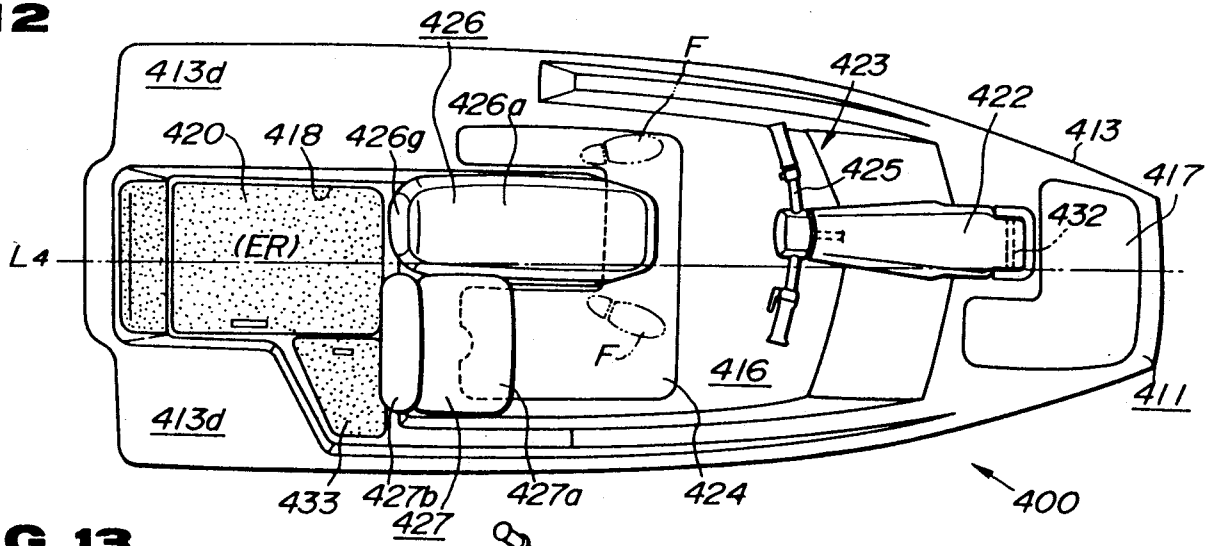
FIGS. 12 and 13 are plan and side elevational views, respectively, of an astride-type small boat according to a fourth embodiment of the present invention.
Figure 13:
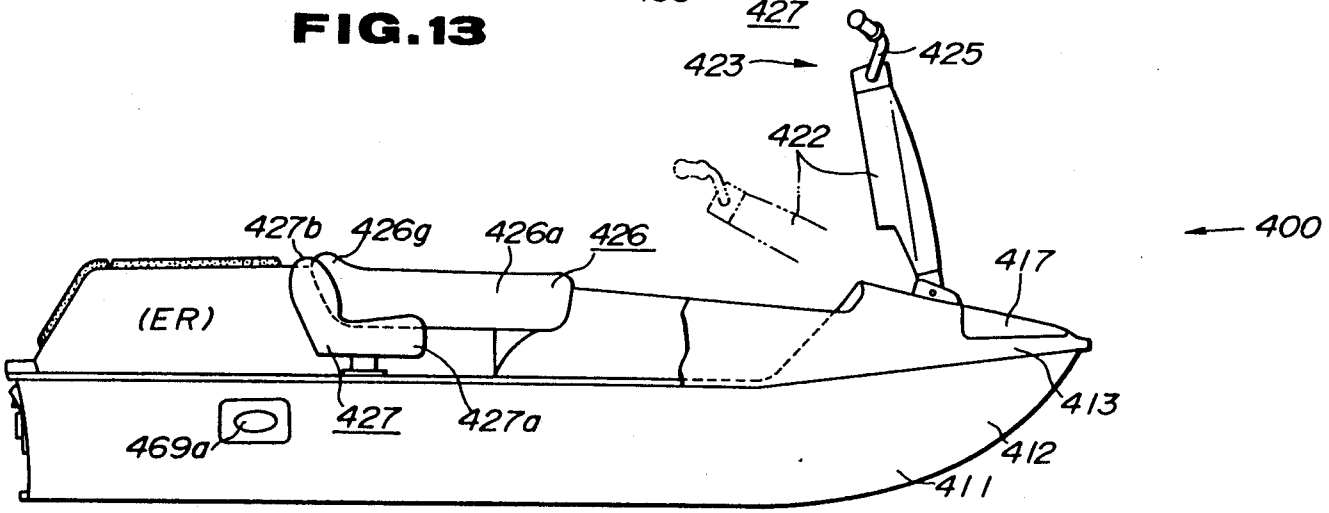

FIGS. 12 and 13 show a recreational astride-type small boat 400 according to a fourth embodiment of the present invention. Those parts shown in FIGS. 12 and 13 which are identical to those of the small boat 10 according to the first embodiment are denoted by identical reference numerals plus "400", and will not be described in detail.

The small boat 400 has a steering post 422 supported on a deck 413 forwardly of a cabin 416. The steering post 422 is pivotally mounted on the deck 413 by a tilt shaft 432 (FIG. 12) for angular movement in the fore-and-aft direction about the tilt shaft 432 as shown in FIG. 13. When the steering post 422 is angularly moved forwardly, it is in a substantially upright position. When the steering post 422 is angularly moved rearwardly, it extends substantially horizontally in the rearward direction. In the rearwardly tilted position, a steering handle 425 mounted on the steering post 422 is positioned immediately in front of a driver's seat 426.

The driver's seat 426 has a seat bottom **426*a* that is elongate in the fore-and-aft direction. The small boat 400 also has a passenger's seat 427 positioned closely to the driver's seat 426. The driver's seat 426 has a rear protrusion 426*g* on its rear end, and the passenger's seat 427 has a seat back 427*b* on its rear end. The protrusion 426*g* and the seat back 427*b* are aligned with each other in the transverse direction of the boat 400. The deck 413 has foot spaces F on the opposite sides of a front portion of the driver's seat 426. The seats 426, 427 are disposed on the lefthand and righthand sides, respectively, of a longitudinal central line L4 of the boat 400**.

The small boat 400 has a storage box 433 in a rear portion of a hull assembly 411, the storage box 433 being positioned on the righthand side of and adjacent to the engine compartment ER. The deck 413 includes flat deck surfaces **413*d* one on each side of an opening 418 of the engine compartment ER. As shown in FIG. 12, the storage box 427 is positioned right behind the passenger's seat 427**.

Since the steering post 422 is tiltable in the fore-and-aft direction and the flat deck surfaces **413*d* are provided on the opposite sides of the engine compartment ER, the driver and the passenger can easily get on and off the boat 400. The storage box 433 positioned immediately behind the passenger's seat 427** can easily be accessed for use.

Figure 14:
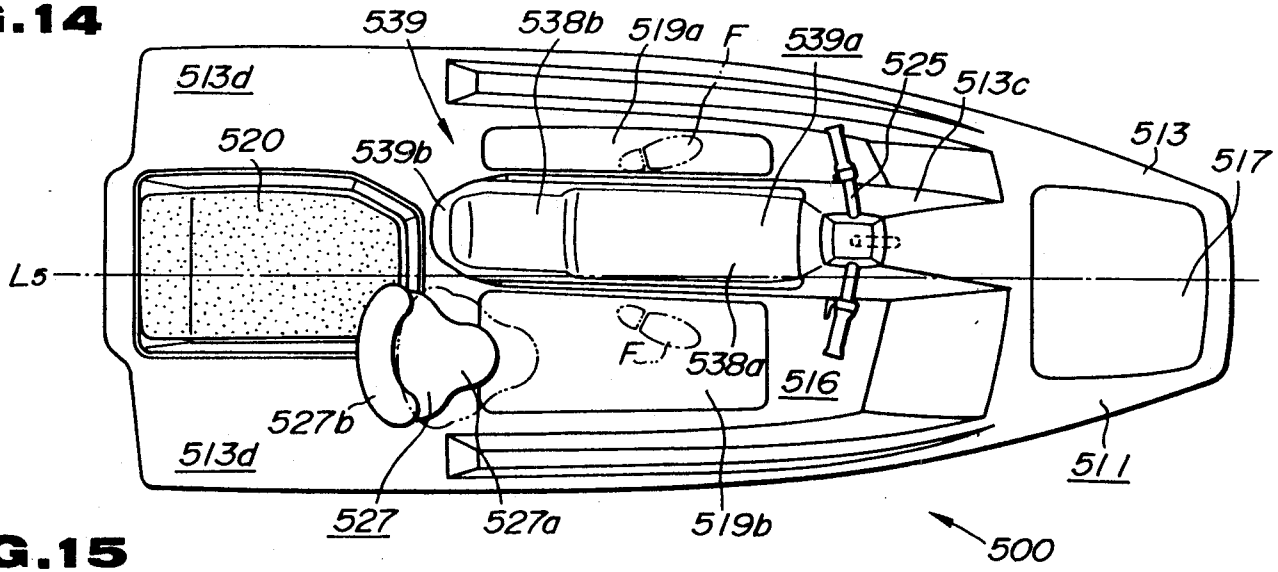
FIGS. 14 and 15 are plan and side elevational views, respectively, of an astride-type small boat according to a fifth embodiment of the present invention.
Figure 15:
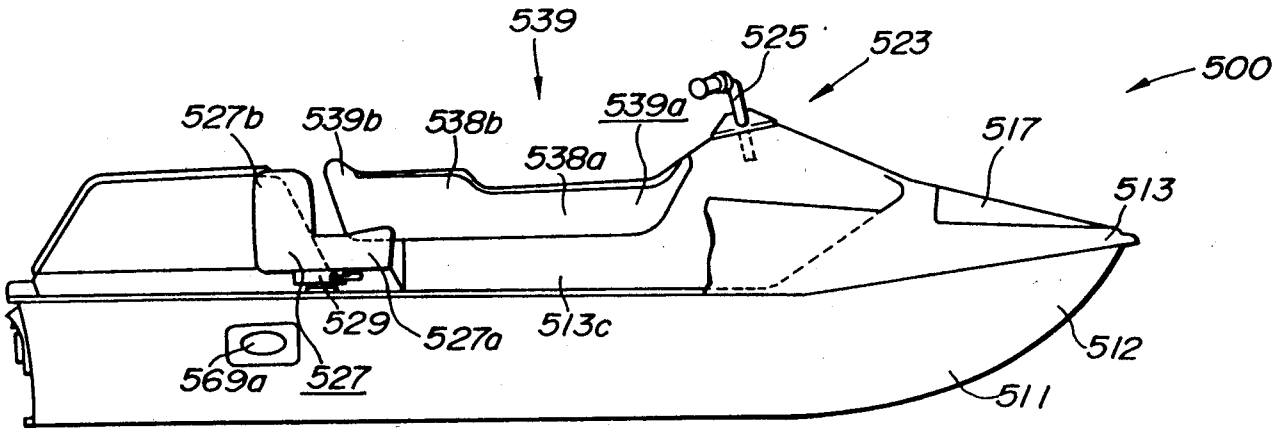

FIGS. 14 and 15 show a recreational astride-type small boat 500 according to a fifth embodiment of the present invention. Those parts shown in FIGS. 14 and 15 which are identical to those of the small boat 10 according to the first embodiment are denoted by identical reference numerals plus "500", and will not be described in detail.

The small boat 500 has a seat configuration for allowing three persons to be on board at the same time. More specifically, the small boat 500 has a raised portion **513*c* positioned in a cabin 516 of a deck 513 and displaced to the left from a longitudinal central line L5 of a hull assembly 511. The raised portion 513*c* extends in the fore-and-aft direction and is contiguous to front and rear walls of the cabin 516. The boat 500 includes a tandem seat 539 mounted on the raised portion 513*c* for two persons to sit on, and a passenger's seat 527** displaced to the right from the longitudinal central line L5.

The tandem seat 539 has a seat bottom **539*a* elongate in the fore-and-aft direction and a protrusion 539*b* integrally projected from the rear end thereof. The seat bottom 539*a* has a stepped shape including a front driver seat region 538*a* and a rear passenger seat region 538*b*, the driver seat region 538*a* corresponding to a driver's seat. The driver seat region 538*a* is lower than the passenger seat region 538*b*. The deck 513 has foot spaces F for the driver on the opposite sides of the seat bottom 539***a* of the tandem seat 539. The tandem seat 539 and the passenger's seat 527 are disposed respectively on the lefthand and righthand sides of the longitudinal central line L5.

The passenger's seat 527 has a seat bottom 527*a* whose upper surface is lower than the upper surface of the driver seat region 539*a* of the tandem seat 539. The passenger's seat 527 is positionally adjustable in the fore-and-aft direction as indicated by the imaginary line in FIG. 14. Therefore, the passenger's seat 527 may be positioned such that the center of the seat bottom 527*a*, as viewed in plan, is substantially aligned with the protrusion 539*b* of the tandem seat 539 in the transverse direction of the boat 500, i.e., the front edge of the seat bottom 527*a* is positioned behind the center of the passenger seat region 538*b* of the tandem seat 538, as viewed in plan.

The boat 500 has a central compartment (not shown) storing a fuel tank. The central compartment is open upwardly on the opposite sides of the raised portion 513*c*, and openably and closably covered with lids 519*a*, 519*b* on the opposite sides of the raised portion 513*c*.

The driver and a passenger can be seated on the tandem seat 539, and another passenger can be seated on the passenger's seat 527. The tandem seat 539 and the passenger's seat 527 are staggered with respect to each other. The passenger's seat 527 is positionally adjustable in the fore-and-aft direction. The passenger seat region 538*b* of the tandem seat 539, which is positioned substantially centrally in the hull assembly 511 in the fore-and-aft direction, has its upper surface higher than the upper surface of the driver seat region 538*a* and also the upper surface of the seat bottom 527*a* of the passenger's seat 527. Thus, while the width of the boat 500 is not increased, relatively large spaces are available around the driver and passenger seated on the tandem seat 539 and the passenger seated on the passenger's seat 527, allowing the driver and passengers to stay on board comfortably.

Figure 16:
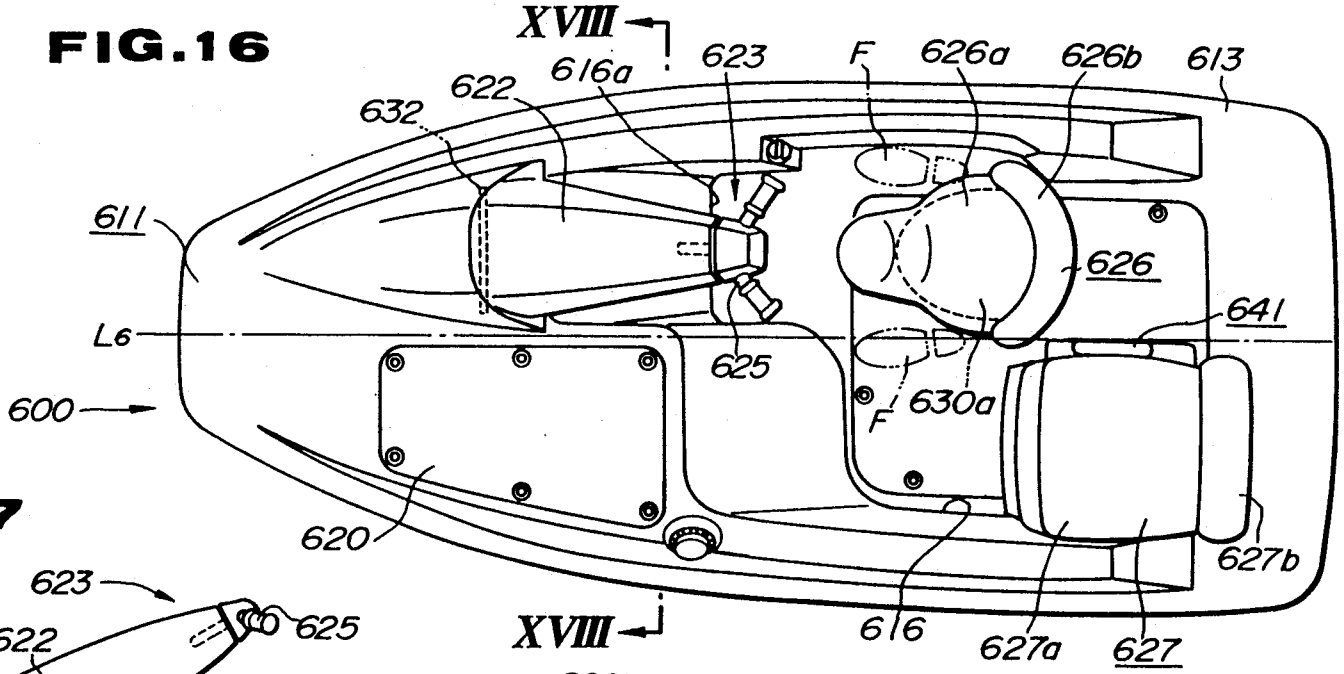
FIGS. 16 and 17 are plan and sectional side elevational views, respectively, of an astride-type small boat according to a sixth embodiment of the present invention.
Figure 17:
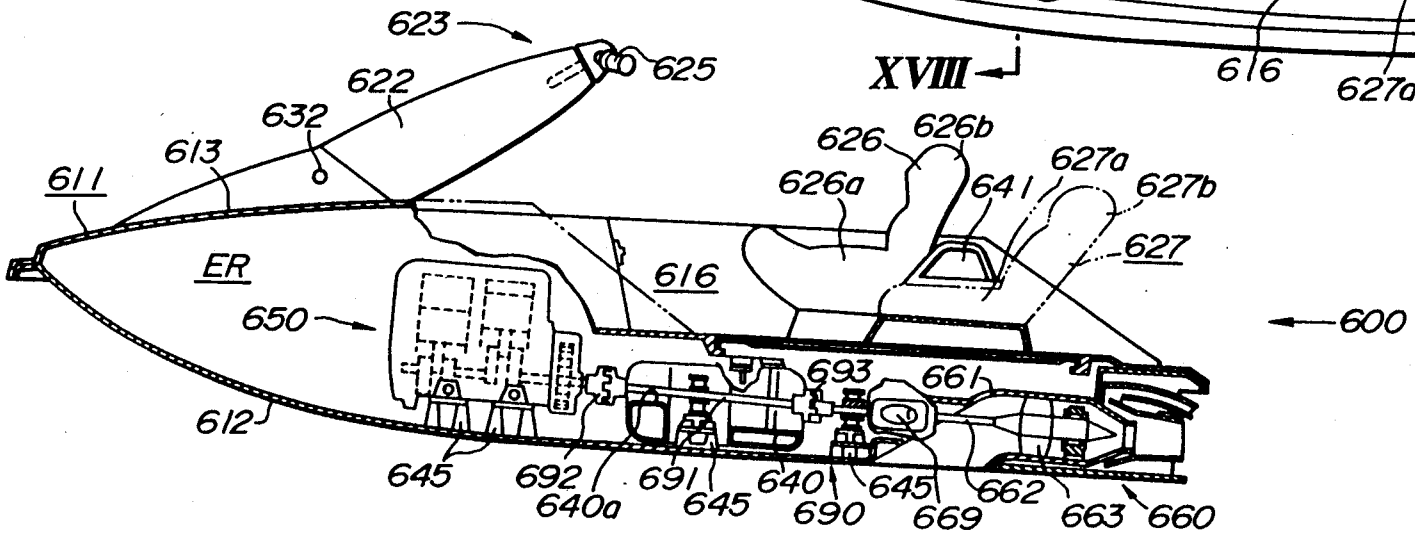
Figure 18:
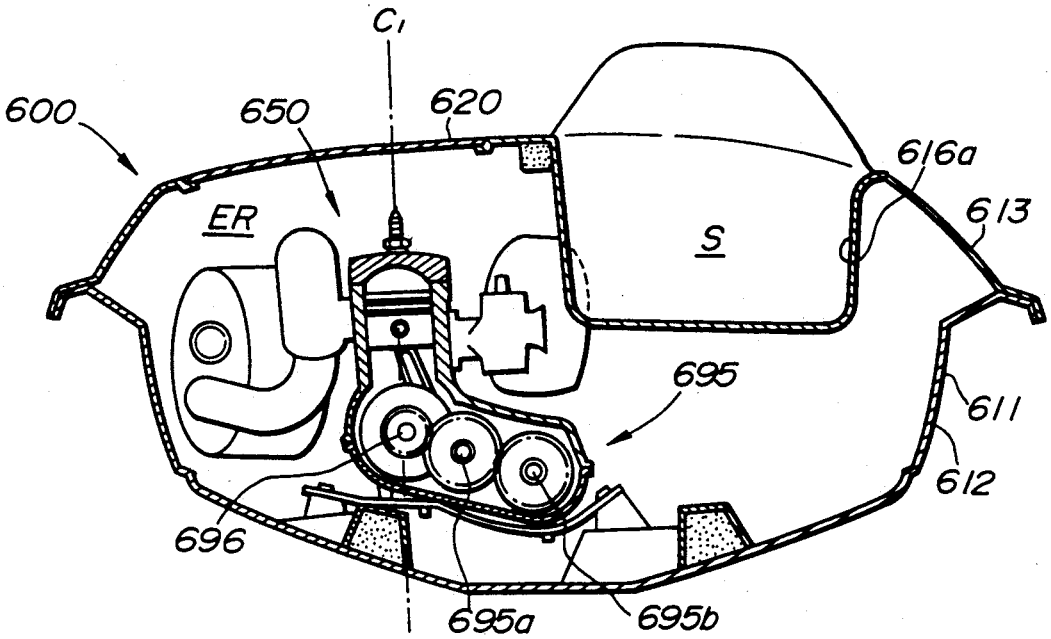
FIG. 18 is a cross-sectional view taken along line XVIII—XVIII of FIG. 16.

FIGS. 16 through 18 show a recreational astride-type small boat 600 according to a sixth embodiment of the present invention. Those parts shown in FIGS. 16 through 18 which are identical to those of the small boat 10 according to the first embodiment are denoted by identical reference numerals plus "600", and will not be described in detail.

As shown in FIG. 16, the small boat 600 has a driver's seat 626 and a passenger's seat 627 that are staggered with respect to each other in a cabin 616 of a deck 613. The driver's seat 626 and the passenger's seat 627 are disposed respectively on the righthand and lefthand sides of a longitudinal central line L6. The cabin 616 has an extension 616*a* positioned in front of the driver's seat 626, providing a space S for allowing the driver's legs to be stretched therein on the floor of the extension 616*a*. A steering device 623 having a steering post 622 that is tiltable about a tilt shaft 632 is mounted on the deck 613 forwardly of the extension 616, i.e., forwardly of the driver's seat 626. The passenger's seat 627 has a grip 641 on the righthand side of a seat bottom 627*a* thereof.

As shown in FIG. 17, the small boat 600 has a hull assembly 611 that houses an engine 650 in a front portion thereof, a propulsion unit 660 in a rear portion thereof, and a fuel tank 640 in a central portion thereof. The engine 650 and the propulsion unit 660 are operatively coupled to each other by a power transmitting device 690. The engine 650, the fuel tank 640, and the propulsion unit 660 are mounted on frame members 645 on the bottom of a hull 612 of the hull assembly 611.

As shown in FIG. 18, the engine 650 comprises a two-stroke vertical engine having a vertical cylinder axis C1. The engine 650 is combined with a transmission mechanism 695. The engine 650 is displaced into a lefthand portion of the hull assembly 611, and hence has a crankshaft 696 extending in the fore-and-aft direction in the lefthand portion of the hull assembly 611.

The transmission mechanism 695 comprises a known parallel-gear transmission mechanism that has a main shaft 695*a* and a countershaft 695*b* which are spaced from each other in the transverse direction of the boat 600 and extend in the fore-and-aft direction of the boat 600. The main shaft 695*a* and the countershaft 695*b* support gears that are in mesh with each other. The main shaft 695*a* is operatively connected to a crankshaft 650*a* of the engine 650 by a driven gear fixedly mounted on the main shaft 695*a* and a drive gear fixedly mounted on the crankshaft 650*a* and meshing with the driven gear. The countershaft 695*b* is positioned centrally in the transverse direction of the hull assembly 611, and is operatively coupled to the power transmitting device 690.

As shown in FIG. 17, the power transmitting device 690 has an intermediate shaft 691 positioned centrally and extending in the fore-and-direction of the hull assembly 611. The intermediate shaft 691 has a front end connected to the countershaft 695*b* of the transmission mechanism 695 through a coupling 692, and a rear end connected to an impeller shaft 662 of the propulsion unit 660 through a coupling 693. The intermediate shaft 691 is disposed in a recess 640*a* defined in a fuel tank 640.

The propulsion unit 660 has an impeller 663 fixed to the impeller shaft 662 and disposed in a pump housing 661. The impeller shaft 662 is coupled to the power transmitting device 690, as described above. The impeller 663 is thus rotatable by the engine 650 to eject water for producing propulsive forces. The structural details of the propulsion unit 660 downstream of the impeller shaft 662 are identical to those of the propulsion unit 60 according to the first embodiment, and will not be described below.

In the small boat 600, as described above, the engine 650 is disposed in the front portion of the hull assembly 611, the propulsion unit 660 in the rear portion of the hull assembly 611, and the fuel tank 640 centrally in the fore-and-aft direction of the hull assembly 611. As a result, the weight distribution of the boat 600 is uniformized in the fore-and-aft direction. Since the engine 650 is disposed in the leftwardly displaced region of the front portion of the hull assembly 611, a large spare space is created in a front righthand portion of the hull assembly 611. Such a large spare space serves as a foot space S for the driver to stretch the legs therein in front of the driver's seat 626.

The fuel tank 640 is positioned centrally in the fore-and-aft direction of the hull assembly 611 and disposed below the seats 626, 627. Therefore, even when the amount of fuel in the fuel tank 640 varies, the weight balance of the boat 600 is not greatly affected. The storage capacity of the fuel tank 640 is not limited by the engine 650.

Figure 19:
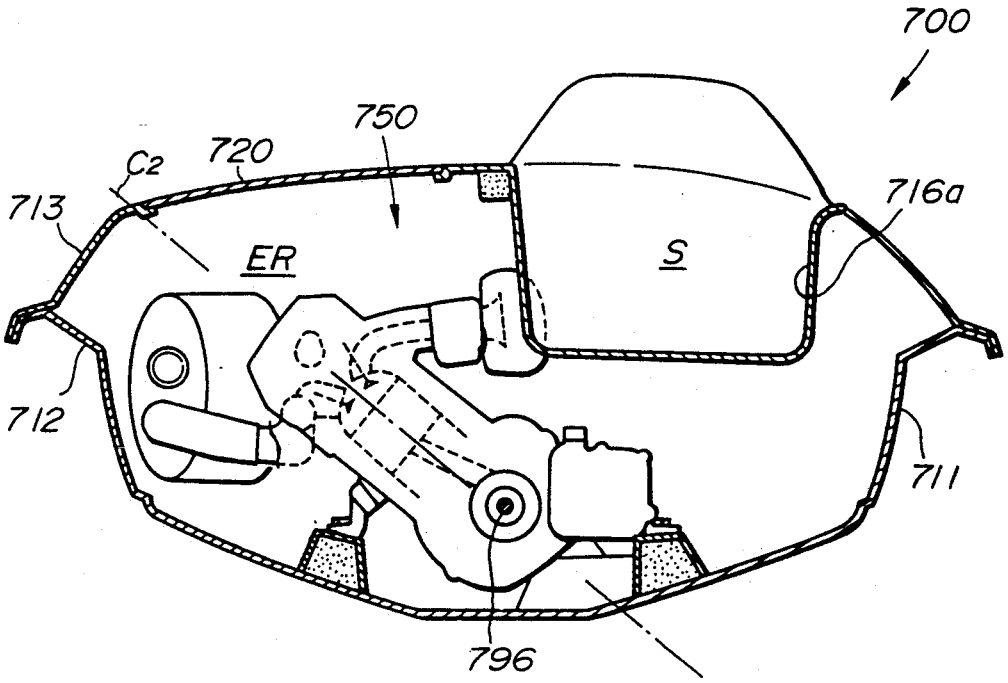
FIG. 19 is a cross-sectional view showing an alternative engine for the astride-type small boat shown in FIGS. 16 through 18.

The engine on the boat 600 is not limited to the illustrated structure, but may be a four-stroke engine 750 as shown in FIG. 19. In FIG. 19, the four-stroke engine 750 has a cylinder axis C2 inclined to the left in the transverse direction of a hull assembly 711, with its cylinder head positioned in a lefthand portion of the hull assembly 711 and its cylinder block positioned centrally in the hull assembly 711 in the fore-and-aft direction. The four-stroke engine 750 has a crankshaft 796 positioned at the center of the hull assembly 711. Though the engine 750 is positioned as a whole in the lefthand portion of the hull assembly 711, the crankshaft 796 is positioned centrally in the transverse direction of the hull assembly 711 without any transmission mechanism employed.

On the small boat 600, the driver's seat 626 and the passenger's seat 627 are staggered with respect to each other, with relatively large spaces created around the seats 626, 627 without an increase in the width of the boat 600. Therefore, the driver and the passenger who are seated on the respective seats 626, 627 can stay on board comfortably in a relaxed manner.

Although there have been described what are at present considered to be the preferred embodiments of the invention, it will be understood that the invention may be embodied in other specific forms without departing from the essential characteristics and scope thereof. The present embodiments are therefore to be considered in all respects as illustrative, and not restrictive. The scope of the invention is indicated by the appended claims rather than by the foregoing description.

What is claimed is:

1. A small boat for movement on water under propulsive forces generated by a propulsion unit driven by an engine mounted in a hull assembly, wherein the improvement comprises a driver's seat disposed on the hull assembly rearwardly of a steering device mounted thereon, with foot spaces defined on opposite sides of said driver's seat, and a passenger's seat displaced from said driver's seat in a transverse direction of the hull assembly, said passenger's seat being displaced from said driver's seat in a fore-and-aft direction of the hull assembly, said hull assembly having a longitudinal central line, said driver's seat being disposed on one side of said longitudinal central line, said passenger's seat being disposed on the other side of said longitudinal central line, said passenger's seat being disposed on the other side of said longitudinal central line.

2. A small boat according to claim 1, wherein said driver's seat and said passenger's seat have seating surfaces at respective different heights.

3. A small boat according to claim 1, wherein said hull assembly has an engine compartment defined in a rear portion thereof, rearwardly of said driver's seat, said engine being housed in said engine compartment rearwardly of said driver's seat.

4. A small boat according to claim 1, further including a fuel tank disposed in said hull assembly forwardly of said engine and under said driver's seat.

5. A small boat according to claim 4, wherein said hull assembly has a trunk compartment defined in a bow side thereof.

6. A small boat according to claim 1, wherein said hull assembly has a space defined in front of a front edge of a seating surface of said driver's seat, for the legs of a driver seated on said driver's seat to be stretched therein, and wherein said engine is mounted in said hull rearwardly of said driver's seat.

7. A small boat according to claim 1, wherein said steering device has a steering post and a control bar mounted on a distal end of said steering post, said steering post having a proximal end tiltable supported on a bow side of the hull assembly, said distal end of the steering post extending toward said driver's seat, the engine in said hull being rearwardly of said driver's seat.

8. A small boat for movement on water under propulsive forces generated by a propulsion unit driven by an engine mounted in the hull assembly, wherein the improvement comprises a driver's seat disposed on a hull assembly rearwardly of a steering device mounted thereon, with foot spaces defined on opposite sides of said driver's seat, and a passenger's seat displaced from said driver's seat in a transverse direction of the hull assembly, at least one of said driver's seat and said passenger's seat having a seating surface at an adjustable height.

9. A small boat for movement on water under propulsive forces generated by a propulsion unit driven by an engine mounted in a hull assembly, wherein the improvement comprises a driver's seat disposed on the a hull assembly rearwardly of a steering device mounted thereon, with foot spaces defined on opposite sides of said driver's seat, and a passenger's seat displaced from said driver's seat in a transverse direction of the hull assembly, said driver's seat and said passenger's seat having respective seating surfaces, the seating surface of said driver's seat being higher than the seating surface of said passenger's seat.

10. A small boat for movement on water under propulsive forces generated by a propulsion unit driven by an engine mounted in a hull assembly, wherein the improvement comprises a driver's seat disposed on the hull assembly rearwardly of a steering device mounted thereon, with foot spaces defined on opposite sides of said driver's seat, and a passenger's seat displaced from said driver's seat in a transverse direction of the hull assembly, said hull assembly having an engine compartment defined in one side of a rear position thereof in said transverse direction, said engine being housed in said engine compartment.

11. A small boat according to claim 10, wherein said driver's seat is disposed on the opposite side of said hull assembly in said transverse direction, with respect to said engine compartment.

12. A small boat for movement on water under propulsive forces generated by a propulsion unit driven by an engine mounted in a hull assembly, wherein the improvement comprises an engine compartment defined in a rear portion of the hull assembly, said engine being housed in said engine compartment, a driver's seat disposed on the hull assembly rearwardly of a steering device mounted thereon, with foot spaces defined on opposite sides of said driver's seat, said engine being rearwardly of said driver's seat, and a passenger's seat displaced from said driver's seat in a transverse direction of the hull assembly.

13. A small boat according to claim 12, wherein said passenger's seat is displaced from said driver's seat in a fore-and-aft direction of the hull assembly.

14. A small boat having an engine, wherein the improvement comprises a hull assembly including a raised floor deck extending from a center thereof toward a bow side thereof and displaced to one side thereof, said raised floor deck defining an engine compartment therein, said engine being housed in said engine compartment, a steering device mounted on an opposite side of the hull assembly, a driver's seat disposed rearwardly of said steering device, and a space for allowing legs of a driver seated on said driver's seat to be stretched therein, said space being defined in front of said driver's seat on an opposite side of the hull assembly adjacent to said engine compartment.

15. A small boat according to claim 14, further including a passenger's seat disposed rearwardly of said driver's seat in staggered relationship thereto.

16. A small boat according to claim 15, wherein said engine has a crankshaft disposed in the center of said hull assembly, said engine having a cylinder axis inclined toward said one side of the hull assembly.

17. A small boat according to claim 14, further including a propulsion shaft disposed in the center of said hull assembly, said engine having a crankshaft disposed in said engine compartment and extending parallel to said propulsion shaft, and means, connected between said crankshaft and said propulsion shaft, for transmitting drive power from said crankshaft to said propulsion shaft.

18. A small boat according to claim 14, wherein said space has a portion positioned below said steering device, said steering device being angularly movable vertically about an end thereof near a bow side of the hull assembly.

19. A small boat for movement on water under propulsive forces generated by a propulsion unit driven by an engine, wherein the improvement comprises a driver's seat disposed on the hull assembly rearwardly of a steering device mounted thereon, with foot spaces defined on opposite sides of said driver's seat, and a passenger's seat displaced from said driver's seat in a transverse direction of the hull assembly, said passenger's seat being displaced from said driver's seat in a fore-and-aft direction of the hull assembly, said hull assembly having a longitudinal central line, said driver's seat being disposed on one side of said longitudinal central line, said passenger's seat being disposed on the other side of said longitudinal central line.

* * * * *